US010570650B2

(12) United States Patent
Perkins

(10) Patent No.: US 10,570,650 B2
(45) Date of Patent: Feb. 25, 2020

(54) APPARATUS AND METHOD FOR ACTUATING A SWITCH OR SENSOR

(71) Applicant: INTEVA PRODUCTS LLC, Troy, MI (US)

(72) Inventor: Donald M. Perkins, Sterling Heights, MI (US)

(73) Assignee: INTEVA PRODUCTS, LLC, Troy, MI (US)

( * ) Notice: Subject to any disclaimer, the term of this patent is extended or adjusted under 35 U.S.C. 154(b) by 860 days.

(21) Appl. No.: 15/014,708

(22) Filed: Feb. 3, 2016

(65) Prior Publication Data

US 2016/0230427 A1 Aug. 11, 2016

Related U.S. Application Data

(60) Provisional application No. 62/113,370, filed on Feb. 6, 2015.

(51) Int. Cl.
*E05B 81/64* (2014.01)

(52) U.S. Cl.
CPC ..... *E05B 81/64* (2013.01)

(58) Field of Classification Search
CPC ..... E05B 81/64; E05B 81/68; E05B 81/74
See application file for complete search history.

(56) References Cited

U.S. PATENT DOCUMENTS 5,273,324 A * 12/1993 Kobayashi ..... E05B 81/20 292/201
5,516,164 A * 5/1996 Kobayashi ..... E05B 81/20 292/201
6,416,088 B1 * 7/2002 Graute ..... E05B 81/14 292/201
8,919,828 B2 12/2014 Barth et al.
9,784,021 B2 10/2017 Torka et al.
2006/0055178 A1 3/2006 Graute
(Continued)

FOREIGN PATENT DOCUMENTS

CN 101457609 A 6/2009
CN 102084074 A 6/2011
(Continued)

OTHER PUBLICATIONS

CN Search Report for Application No. 201610081992.4.
(Continued)

*Primary Examiner* — Mark A Williams
(74) *Attorney, Agent, or Firm* — Cantor Colburn LLP

(57) ABSTRACT

A latch assembly is provided herein. The latch assembly having: a lock lever rotatably mounted to the latch assembly for movement between a first position and a second position; a switch positioned to detect movement of the lock lever between the first position and the second position, the switch being located in a carrier; an actuating lever rotatably mounted to the carrier for movement between a first position and a second position, wherein the actuating lever is operably coupled to the lock lever such that movement of the lock lever from the first position to the second position causes the actuating lever to move from the first position to the second position; and wherein the switch is located in a first plane along with at least one other switch and the lock lever rotates in a second plane that is different from the first plane.

20 Claims, 4 Drawing Sheets

(56) References Cited

U.S. PATENT DOCUMENTS

| | | | | |
|---|---|---|---|---|
| 2007/0029814 | A1* | 2/2007 | Coleman | E05B 81/14 292/201 |
| 2007/0046035 | A1* | 3/2007 | Tolley | E05B 81/06 292/201 |
| 2009/0151257 | A1 | 6/2009 | Dominique | |
| 2010/0244466 | A1* | 9/2010 | Tomaszewski | E05B 77/26 292/201 |
| 2011/0254288 | A1* | 10/2011 | Gaucher | E05B 85/26 292/240 |
| 2012/0193926 | A1* | 8/2012 | Watanabe | E05B 77/34 292/195 |
| 2013/0049379 | A1* | 2/2013 | Yokota | E05B 81/20 292/129 |
| 2016/0230427 | A1 | 8/2016 | Perkins | |

FOREIGN PATENT DOCUMENTS

| | | | |
|---|---|---|---|
| CN | 104169510 | A | 11/2014 |
| CN | 205778036 | U | 12/2016 |
| WO | 2006000190 | A1 | 1/2006 |
| WO | 2007088170 | A1 | 8/2007 |

OTHER PUBLICATIONS

English Translation of the First Office Action for Application No. 201610081992.4; dated Oct. 10, 2017.
English Translation to Second CN Office Action for Application No. 201610081992.4; dated Jun. 28, 2018.
First Office Action for Application No. 201610081992.4; dated Oct. 10, 2017.
Second CN Office Action for Application No. 201610081992.4; dated Jun. 28, 2018.

* cited by examiner

APPARATUS AND METHOD FOR ACTUATING A SWITCH OR SENSOR

CROSS REFERENCE TO RELATED APPLICATIONS

This application claims the benefit of U.S. Provisional Patent Application Ser. No. 62/113,370 filed on Feb. 6, 2015, the contents of which are incorporated herein by reference thereto.

BACKGROUND

Various embodiments of the present invention relate to an apparatus and method for actuating a switch sensor. More particularly, various embodiments of the present invention relate to an apparatus and method for actuating a switch sensor of a vehicle latch.

Current trends in automotive door latch design involve minimizing the material used in the electrical architecture in order to reduce cost. Another trend is to reduce mass which involves decreasing package size of the latch assembly while maintaining the features original equipment manufacturers (OEMs) are looking for. Both of these trends together pose a challenge when designing and locating position sensing devices within the latch assembly. Moreover, challenges arise when the electrical architecture is on a plane normal to that of the rotating feature the sensor are positioned to sense.

Accordingly, it is desirable to provide an improved method and apparatus for actuating a switch or sensor in a vehicle latch.

SUMMARY OF THE INVENTION

In one embodiment, a latch assembly is provided. The latch assembly having: a lock lever rotatably mounted to the latch assembly for movement between a first position and a second position; a switch positioned to detect movement of the lock lever between the first position and the second position, the switch being located in a carrier; an actuating lever rotatably mounted to the carrier for movement between a first position and a second position, wherein the actuating lever is operably coupled to the lock lever such that movement of the lock lever from the first position to the second position causes the actuating lever to move from the first position to the second position; and wherein the switch is located in a first plane along with at least one other switch and the lock lever rotates in a second plane that is different from the first plane.

In another embodiment, a latch for a door of a vehicle is provided. The latch having: a lock lever rotatably mounted to the latch assembly for movement between a first position corresponding to a locked position and a second position corresponding to an unlocked position, wherein the lock lever is operably coupled to a locking mechanism; a switch positioned to detect movement of the lock lever between the first position and the second position, the switch being located in a carrier; an actuating lever rotatably mounted to the carrier for movement between a first position and a second position, wherein the actuating lever is operably coupled to the lock lever such that movement of the lock lever from the first position to the second position causes the actuating lever to move from the first position to the second position, wherein the actuating lever is spring biased into the first position; and wherein the switch is located in a first plane along with at least two other switches and the lock lever rotates in a second plane that is different from the first plane.

In yet another embodiment, a method for determining a position of a lock lever of a latch is provided. The method including the steps of: rotatably mounting the lock lever to the latch for movement between a first position corresponding to a locked position and a second position corresponding to an unlocked position; providing a switch to detect movement of the lock lever between the first position and the second position, the switch being located in a carrier; rotatably mounting an actuating lever to the carrier for movement between a first position and a second position, wherein the actuating lever is operably coupled to the lock lever such that movement of the lock lever from the first position to the second position causes the actuating lever to move from the first position to the second position, wherein the actuating lever is spring biased into the first position; and wherein the switch is located in a first plane along with at least two other switches and the lock lever rotates in a second plane that is different from the first plane and wherein the switch provides a signal to an electronic control unit.

BRIEF DESCRIPTION OF THE DRAWINGS

These and/or other features, aspects, and advantages of the present invention will become better understood when the following detailed description is read with reference to the accompanying drawings in which like characters represent like parts throughout the drawings, wherein.

Although the drawings represent varied embodiments and features of the present invention, the drawings are not necessarily to scale and certain features may be exaggerated in order to illustrate and explain exemplary embodiments the present invention. The exemplification set forth herein illustrates several aspects of the invention, in one form, and such exemplification is not to be construed as limiting the scope of the invention in any manner.

DETAILED DESCRIPTION

Referring now to the FIGS., an assembly or latch assembly 10 comprising a lock lever 12 and a sensor or switch 14 for detecting movement of the lock lever 12 with respect to a vehicle latch 16 (illustrated schematically) is illustrated. In one embodiment, the vehicle latch 16 may be installed in a door of a vehicle.

Figure 1:
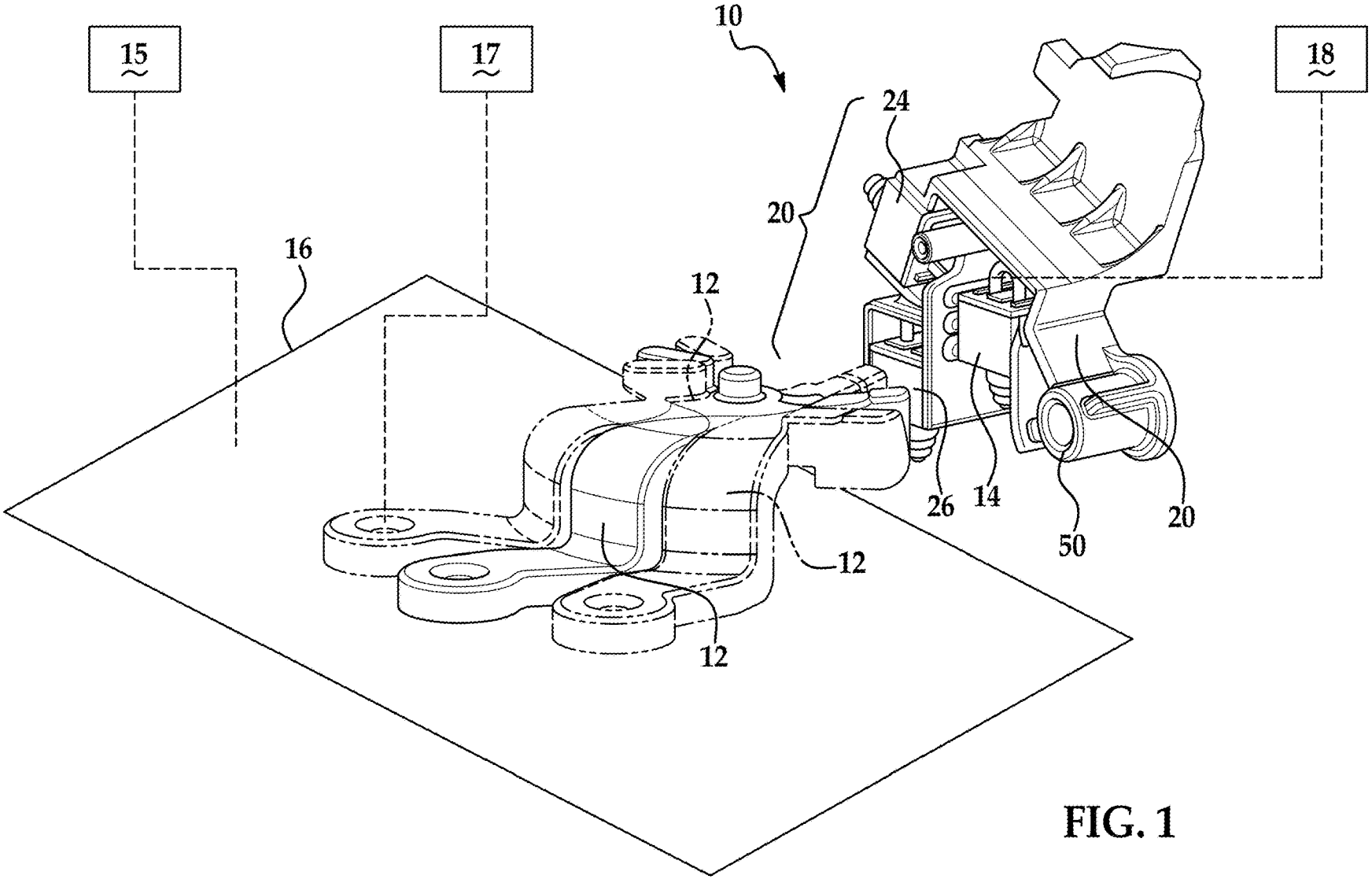
FIG. 1 is a perspective view illustrating at least three positions of a lock lever of a vehicle latch as well as a lock switch and switch carrier positioned to detect movement of the lock lever.

In one embodiment and as illustrated in FIG. 1, the lock lever or lever or outside lock lever 12 is pivotally mounted to the vehicle latch 16 for movement about an axis 18. FIG. 1 illustrates at least three different positions of the lock lever 12. As illustrated in at least FIG. 1, the lock lever is capable of being located in a locked position, a neutral position and an unlocked position. As is known in the related arts movement of the lock lever 12 into the locked position will prevent the latch 16 from transitioning from a latched position to an unlatched position by for example, actuation of a release handle 15 operatively coupled to the latch 16. On the other hand, movement of the lock lever 12 into the unlocked position will allow the latch to transition from a latched position to an unlatched position by for example, actuation of the release handle 15 operatively coupled to the latch.

As is known the related arts movement of the release handle 15 when the latch 16 is an unlocked state via movement of the lock lever 12 will cause a detent lever or pawl (not shown) to become disengaged from a fork bolt or claw (not shown) so that the latch may transition from a latched state to an unlatched state. In one non-limiting embodiment, the lock lever 12 is moved between its various positions by a locking mechanism 17, which is operatively coupled to the lock lever 12. In one embodiment, the locking mechanism 17 may be a key cylinder or motor or any other equivalent device configured to move the lock lever 12 into its various positions as illustrated in at least FIG. 1. In one embodiment, the locking mechanism or key cylinder 17 may be accessible from an exterior of the vehicle the latch 16 is installed in.

Since the operational position of the lock lever 12 of the latch indicates a status of the latch 16 it is desirable to have this position known to an electronic control unit (ECU) or any other equivalent device 18 coupled to sensor or switch 14 such that the state of switch or sensor 14, which corresponds to the position of the lock lever 12, is indicated to the ECU 18.

In one embodiment, the electronic control unit 18 comprises a microprocessor, microcontroller or other equivalent processing device capable of executing commands of computer readable data or program for executing a control algorithm in order to perform prescribed functions and desired processing, as well as computations therefore (e.g., the execution of fourier analysis algorithm(s), control processes prescribed and the like), the controller may include, but not be limited to, a processor(s), computer(s), memory, storage, register(s), timing, interrupt(s), communication interfaces, and input/output signal interfaces, as well as combinations comprising at least one of the foregoing.

FIG. 1 illustrates the geometry of the lock lever 12 and in one embodiment it is desired to provide a position sensing electrical signal from the sensor or switch 14 when the lock lever is in the unlocked position. Switch or sensor 14 is located in a switch carrier 20, which comprises the electrical architecture of the latch assembly or assembly 10. In one embodiment, the switch carrier 20 may be molded or constructed out of an easily moldable material such as plastic. As illustrated, the switch carrier 20 is shown along with the position lock switch or sensor 14 in a manner so as to optimize the overall package size of the latch assembly 10 as well as reducing the amount of material usage for the circuitry of the switch carrier 20 and thus optimizes the component cost of the carrier sub-assembly 20.

Figure 2:
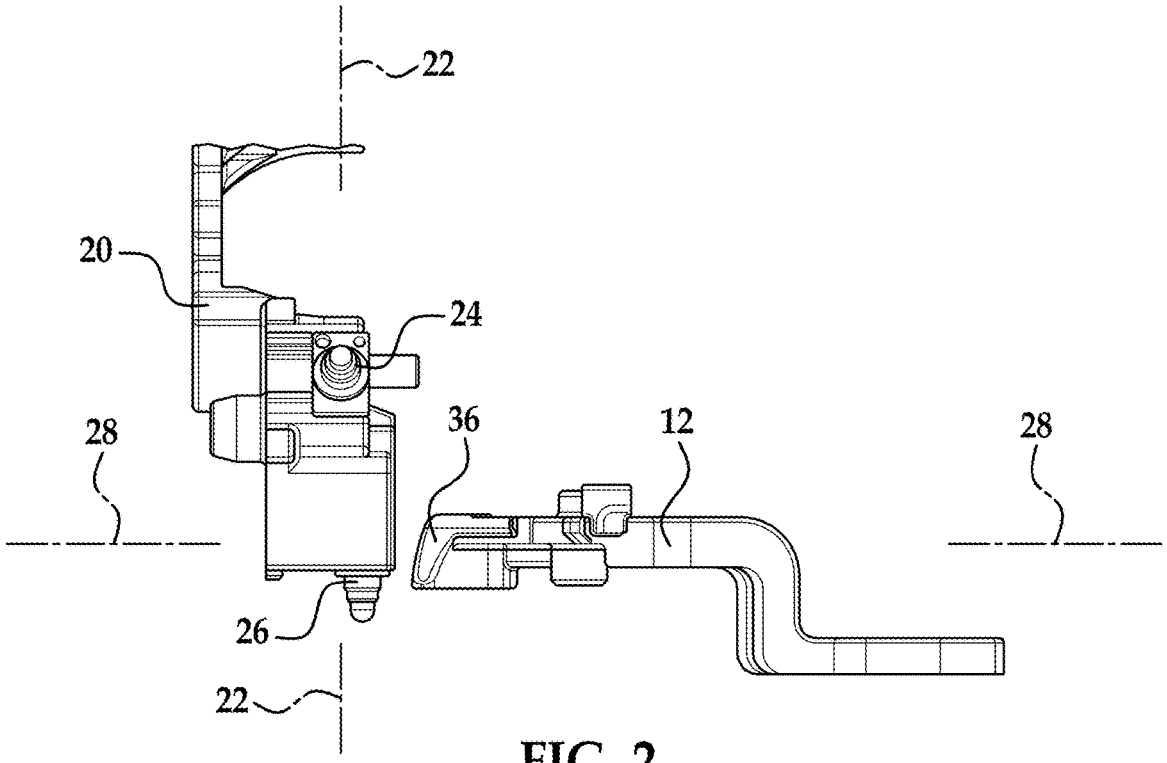
FIG. 2 is an end view illustrating the plane in which the lock lever rotates as well as the plane in which the lock switch is located.

As illustrated in at least FIGS. 1 and 2, the positions of the lock lever 12 and the carrier 20 in one non-limiting implementation are provided. As illustrated, the position of the lock switch or sensor 14 is not in an optimal position for direct actuation by the lock lever 12 due to its rotational movement. In order to move the switch or sensor 14 into an optimal position for direct actuation by the lock lever 12 this would require repositioning the switch or sensor 14 out of a plane 22 of the two other switches 24, 26 located in carrier 20. As such, moving switch or sensor 14 to be closer to lock lever 12 while maintaining the location of switches 24 and 26 so that they may be actuated by other components would drive up the manufacturing cost of the assembly 10 and increase the overall package space required for the latch assembly 10 as more complex circuitry and architecture would be required and the carrier would also have to be modified or enlarged.

FIG. 2 illustrates the relationship between a plane 28 in which lever 12 rotates and the plane 22 of the lock switch 14, switches 24 and 26 as well as carrier or housing 20.

Various embodiments of the present invention were conceived due to the desire to decrease the required packaging space or footprint for a microswitch to sense the position of the lock lever 12 as it rotates within the latch assembly 10. While alternative locations for switch 14 exist or are possible they would have greatly complicated the electrical architecture of the assembly 10 (e.g., carrier 20 etc.) and thus driving the cost of the assembly up as well as requiring additional or a greater packaging space.

In accordance with one non-limiting embodiment of the present invention, an additional actuating lever 30 is provided. Actuating lever 30 is movably or rotatably secured to the carrier 20 and thus allows for optimal packaging design and greatly reduces the complexity of the electrical architecture or circuitry of the switch carrier 20 as multiple switches are located in a single plane, which optimizes the component cost of the carrier sub-assembly 20. In other words, switch 14 can remain in carrier 20 in a plane with at least one other switch and in some instances more than one other switch (e.g., two or more) so that the packaging of the switch carrier or carrier sub-assembly 20 can be optimized (e.g., multiple switches located in a single plane) so that the switches can be actuated by numerous movable components of the latch 16.

Figure 3:
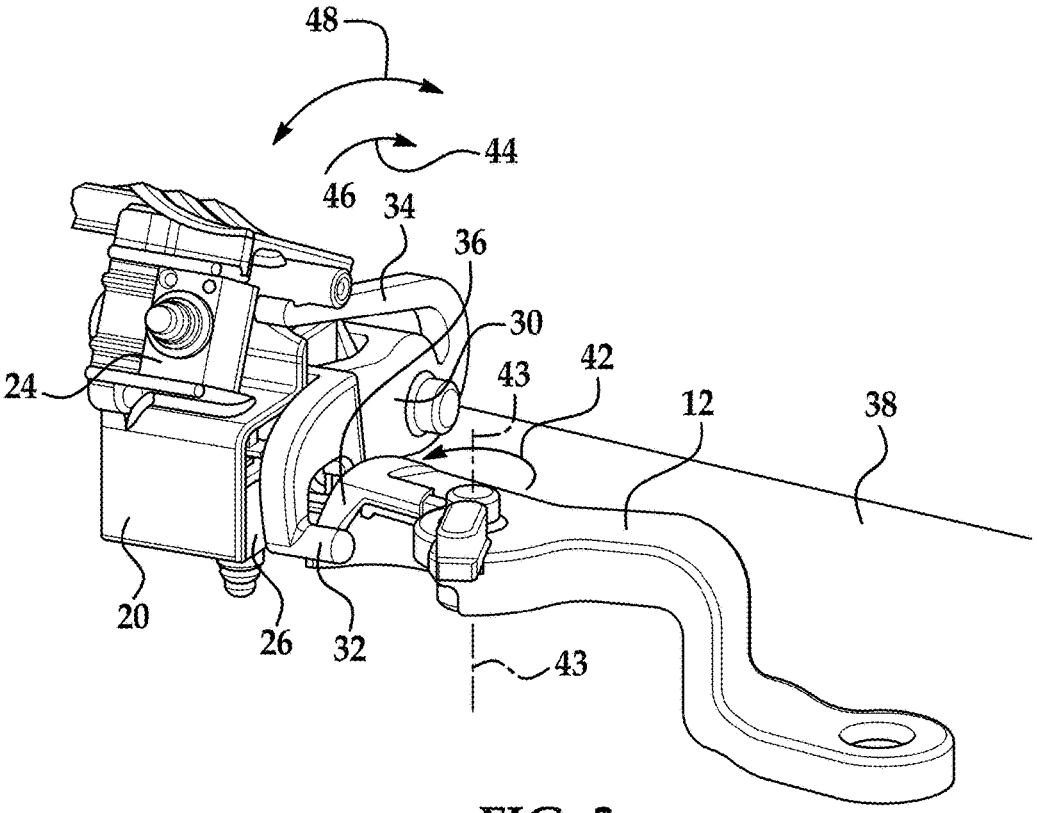
FIG. 3 is a perspective view illustrating the lock lever, the lock switch carrier and a lock switch actuator operably coupling movement of the lock lever to the lock switch and wherein the lock lever and the lock switch actuator are in the first position.

Referring now to at least FIG. 3, the outside lock lever 12 and the outside lock switch actuator or actuating lever 30 are illustrated. The outside lock switch actuator or actuating lever 30 includes an actuating cam follower feature 32 and an integral return spring or spring feature or spring 34. In one embodiment, actuator or actuating lever 30 or at least the integral return spring or spring feature or spring 34 is formed from a material having resilient or elastic characteristics such that as spring feature or spring 34 is deflected in a first direction a biasing force in an opposite direction is provided. In other words, once the spring or spring feature 34 is deflected from a first position by a force the spring or spring feature will return to the first position after removal of the force.

During movement of the outside lock lever 12 between its various positions (e.g., locked, neutral and unlocked), the cam follower feature 32 is contacted by a corresponding cam surface 36 integral with or located on the outside lock lever 12 and as the outside lock lever 12 pivots or rotates the outside lock switch actuator or actuating lever 30 pivots or rotates about an axis 38 in the direction of arrows 40.

As the outside lock lever 12 rotates in the direction of arrow 42 about axis 43, the contact of surface 36 with feature 32 causes the outside lock switch actuator or actuating lever 30 to rotate in the direction of arrow 44. As the outside lock switch actuator or actuating lever 30 rotates in the direction of arrow 44, the integral return spring or spring feature or spring 34 is held against a positioning feature 46 integral to the switch carrier 20.

Figure 4:
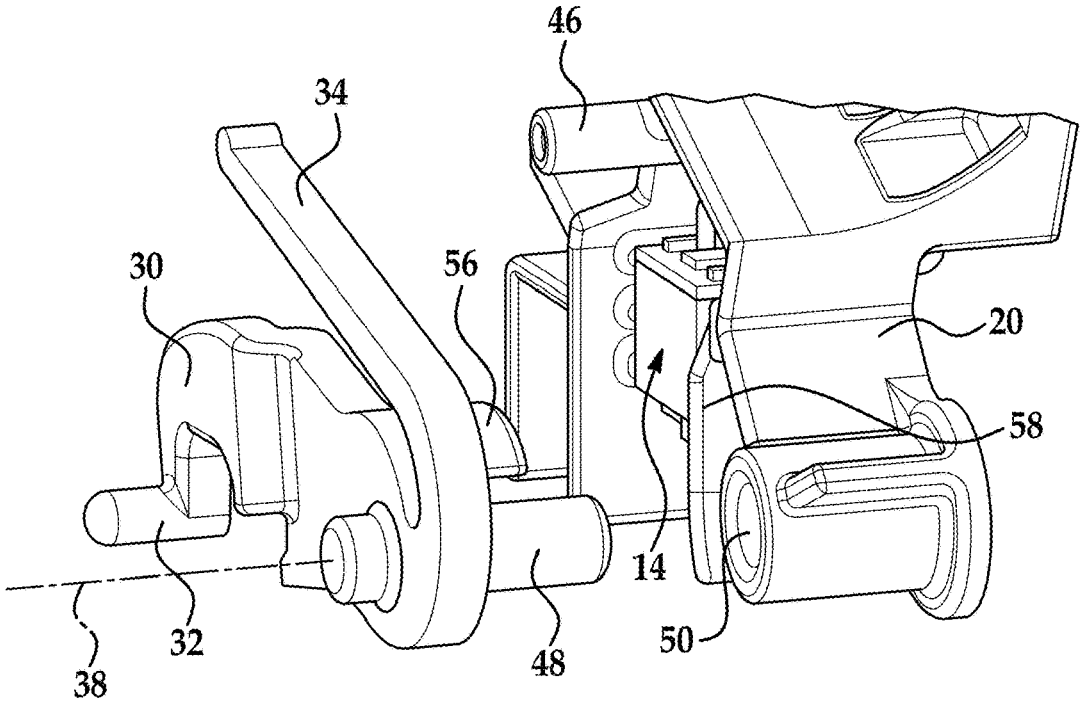
FIG. 4 illustrates the securement of the lock switch actuator into the lock switch carrier.

Referring now to FIG. 4, the axis of rotation 38 of the outside lock switch actuator or actuating lever 30 is achieved via a hub or shaft portion 48 that is rotatably received in a bearing pocket 50 that is also integral to the switch carrier 20.

By locating the controlling features of the outside lock switch actuator or actuating lever 30 on or integral with the switch carrier 20, this also allows the outside lock switch 14 to be positioned in the switch carrier 20 and thus, the tolerances of this subsystem can be controlled with greater accuracy, thereby providing a more robust solution.

Figure 5:
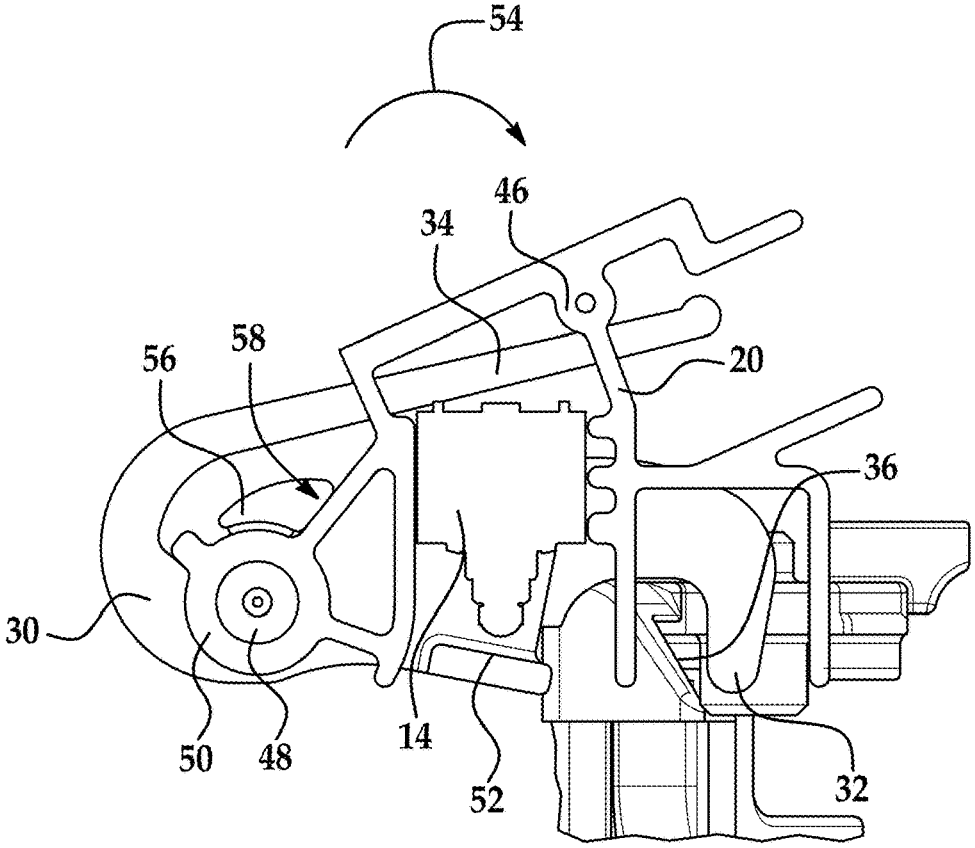
FIG. 5 is a cross sectional view of the lock switch actuator, lock switch and lock switch carrier in a first position.

FIG. 5 is a cross-sectional view of at least the outside lock switch actuator or actuating lever 30, the carrier assembly 20 and the outside lock switch 14. Here the outside lock switch actuator or actuating lever 30 and associated lock lever 12 are in a first position. This FIG. also illustrates the hub or shaft portion 48 rotatably received in bearing pocket 50 of the switch carrier 20. In the position illustrated in FIG. 5, the integral return spring arm 34 is clearly seen as loaded against its corresponding stop feature 46 of the switch carrier 20. Accordingly, a contact surface 52 of the outside lock switch actuator or actuating lever 30 is biased into the position shown by the return force provided by the return spring 34 in the direction of arrow 54. Further rotation of the outside lock switch actuator or actuating lever 30 in the direction of arrow 54 is prevented due to a feature or protrusion 56 of the outside lock switch actuator or actuating lever 30 contacting a corresponding stop feature or surface 58 integral with the switch carrier 20.

The positioning feature or protrusion 56 is held against the corresponding stop surface 58 by the biasing force of the return spring or biasing feature 34 in the direction of arrow 54. As illustrated in FIGS. 3 and 5 and as the cam surface 36 of the lock lever 12 rotates in the direction of arrow 42, it makes contact with the cam follower feature 32 of the outside lock switch actuator or actuating lever 30 causing the outside lock switch actuator 30 to rotate in the direction of arrow 44 and thus cause the switch activation feature or surface 52 to travel towards the outside lock switch 14 while feature or protrusion 56 moves away from surface 58.

Figure 6:
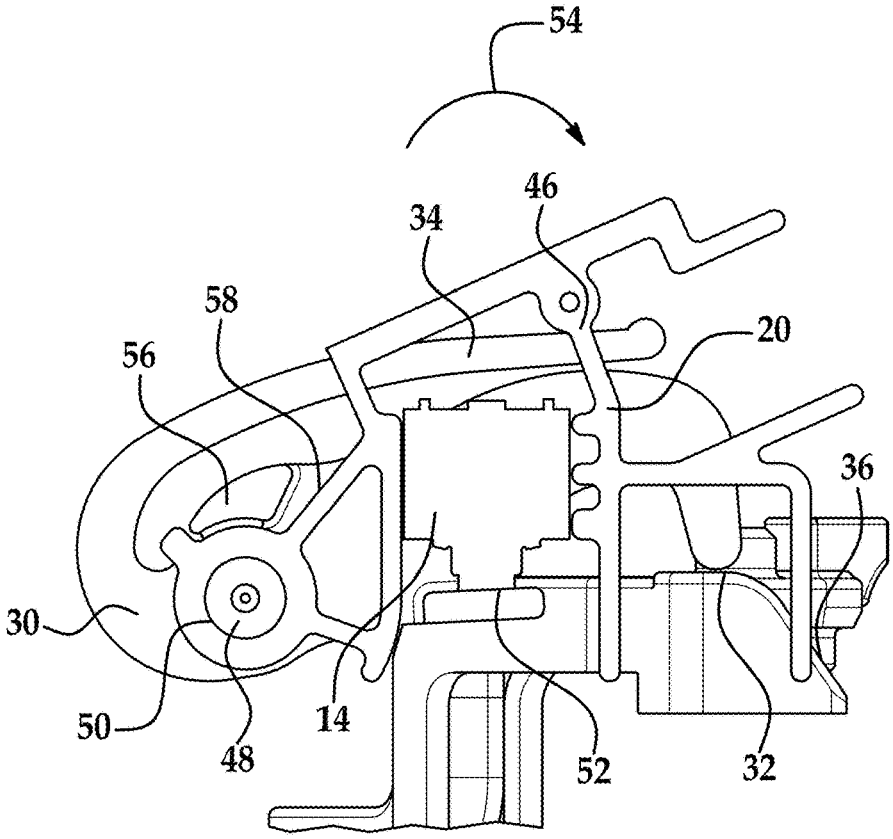
FIG. 6 is a cross sectional view of the lock switch actuator, lock switch and lock switch carrier in a second position.
Figure 7:
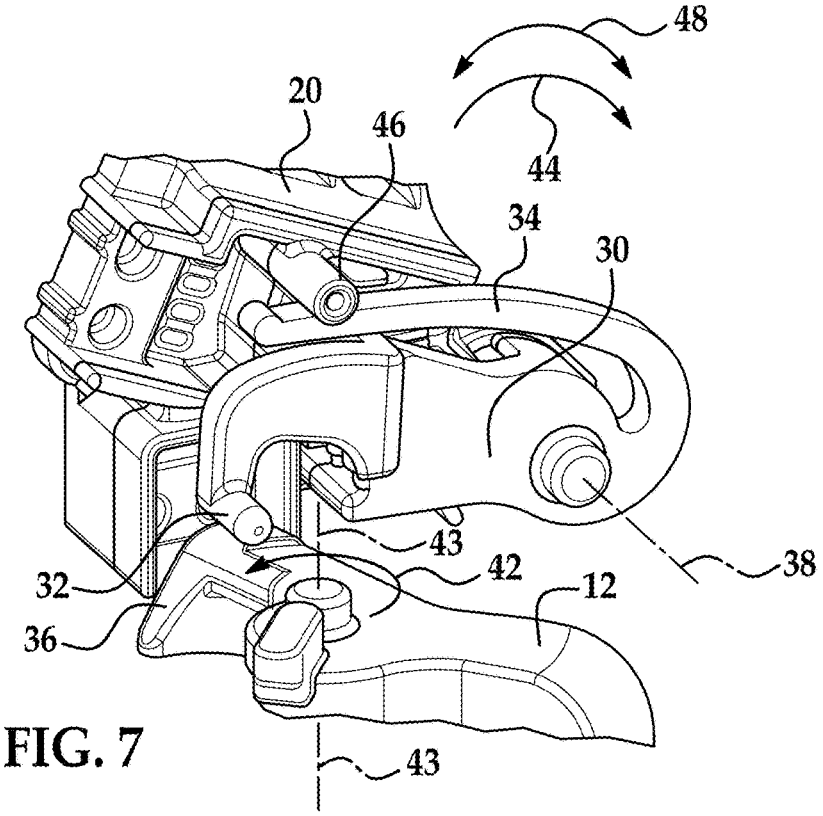
FIG. 7 is a perspective view of the lock switch actuator, lock switch and lock switch carrier in the second position.

FIGS. 6 and 7 illustrate the outside lock switch actuator or actuating lever 30 and the lock lever 12 being rotated or moved from the first position to a second position wherein the lock lever 12 is at its full range of travel in the direction of arrow 42 about axis 43 as indicated by the cam follower 32 being located on the highest surface of the outside lock lever cam surface 36. At this position (e.g., the second position of the lock lever 12 and the outside lock switch actuator or actuating lever 30, the switch activation feature or surface 52 is depressing the outside lock switch 14 to its activated position and the deflection of the integral return spring feature 34 has been flexed from the positions illustrated in FIGS. 3 and 5 to those illustrated in FIGS. 6 and 7 thereby creating a biasing force in the direction of arrow 54 with respect to the portions of the actuator or actuating lever 30 that contact the lock lever 12. Also, the positioning feature or protrusion 56 of the outside lock switch actuator or actuating lever 30 has been rotated or moved away from the corresponding stop surface 58 in a direction opposite to the biasing force of spring 34 (e.g., opposite to arrow 54).

Accordingly and as the lock lever 12 rotates from the second position illustrated in FIGS. 6 and 7 to the first position illustrated in at least FIGS. 3 and 5, the switch 14 is no longer depressed and a different signal is sent to the ECU 18, which is opposite to the signal that is sent to the ECU 18 when the lock lever and actuator 30 are in the second position.

As described herein and in accordance with various embodiments of the present invention, the location of the switch or sensor 14 associated with the lock lever 12 can be located in the same plane as other switches as well as the carrier 20 containing the other switches such that the required electrical circuitry or architecture for the switches is minimized and the required foot print or required amount of real estate for the switches and their carrier is minimized. In one embodiment, this may be achieved by providing an actuating lever 30 rotatably mounted to the carrier 20 such that rotational movement of the lock lever 12 between at least two positions is transferred to the switch or sensor 14 via actuating lever 30 without adversely affecting the required electrical circuitry or architecture for the switches and the required foot print or required amount of real estate for the switches and their carrier.

As used herein, the terms "first," "second," and the like, herein do not denote any order, quantity, or importance, but rather are used to distinguish one element from another, and the terms "a" and "an" herein do not denote a limitation of quantity, but rather denote the presence of at least one of the referenced item. In addition, it is noted that the terms "bottom" and "top" are used herein, unless otherwise noted, merely for convenience of description, and are not limited to any one position or spatial orientation.

The modifier "about" used in connection with a quantity is inclusive of the stated value and has the meaning dictated by the context (e.g., includes the degree of error associated with measurement of the particular quantity).

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A latch assembly, comprising:

a lock lever rotatably mounted to the latch assembly for movement between a first position and a second position, the lock lever being configured to prevent the latch assembly from transitioning between a latched position and an unlatched position when the lock lever is in the first position and the lock lever allowing the latch assembly to transition between the latched position and the unlatched position when the lock lever is in the second position;

a switch positioned to detect movement of the lock lever between the first position and the second position, the switch being located in a switch carrier;

an actuating lever rotatably mounted to the switch carrier for movement between a first position and a second position, wherein the actuating lever is operably coupled to the lock lever such that movement of the lock lever from the first position to the second position causes the actuating lever to move from the first position to the second position; and wherein at least one other switch is located in the switch carrier, the at least one other switch being actuated by a component of the latch assembly, wherein the switch and the at least one other switch are located in a first plane with respect to the latch assembly and the actuating lever rotates in the first plane and the lock lever rotates in a second plane with respect to the latch assembly that is different from the first plane.

2. The latch assembly as in claim 1, wherein the switch is operatively coupled to an electronic control unit (ECU) and wherein a state of the switch corresponds to a position of the lock lever.

3. The latch assembly as in claim 1, wherein the actuating lever further comprises a cam follower feature and an integral return spring, wherein the cam follower feature contacts a cam surface of the lock lever as the lock lever moves from the first position to the second position.

4. The latch assembly as in claim 3, wherein the integral return spring contacts a positioning feature of the switch carrier in order to provide a biasing force to the actuating lever when the lock lever moves from the first position to the second position.

5. The latch assembly as in claim 4, wherein the actuating lever has a shaft portion that is rotatably received in a bearing pocket that is also integral to the switch carrier.

6. The latch assembly as in claim 1, wherein a protrusion of the actuating lever contacts a stop feature of the switch carrier when the actuating lever is in the first position.

7. The latch assembly as in claim 6, wherein the protrusion of the actuating lever moves away from the stop feature of the switch carrier when the actuating lever is moved towards the second position.

8. The latch assembly as in claim 1, wherein the latch assembly is part of a vehicle latch.

9. The latch assembly as in claim 5, wherein the switch is operatively coupled to an electronic control unit (ECU) and wherein a state of the switch corresponds to a position of the lock lever.

10. The latch assembly as in claim 5, wherein a protrusion of the actuating lever contacts a stop feature of the switch carrier when the actuating lever is in the first position.

11. The latch assembly as in claim 10, wherein the protrusion of the actuating lever moves away from the stop feature of the switch carrier when the actuating lever is moved towards the second position.

12. The latch assembly as in claim 11, wherein the switch is operatively coupled to an electronic control unit (ECU) and wherein a state of the switch corresponds to a position of the lock lever.

13. The latch assembly as in claim 12, wherein the latch assembly is part of a vehicle latch.

14. The latch assembly as in claim 1, wherein the lock lever is operatively coupled to a locking mechanism.

15. A latch for a door of a vehicle, the latch comprising:

a lock lever rotatably mounted to the latch assembly for movement between a first position corresponding to a locked position of the latch and a second position corresponding to an unlocked position of the latch, wherein the lock lever is operably coupled to a locking mechanism and the lock lever is configured to prevent the latch from transitioning between a latched position and an unlatched position when it is in the first position and the lock lever allows the latch to transition between the latched position and the unlatched position when it is in the second position;

a switch positioned to detect movement of the lock lever between the first position and the second position, the switch being located in a switch carrier;

an actuating lever rotatably mounted to the switch carrier for movement between a first position and a second position, wherein the actuating lever is operably coupled to the lock lever such that movement of the lock lever from the first position to the second position causes the actuating lever to move from the first position to the second position such that the switch is actuated by the actuating lever, wherein the actuating lever is spring biased into the first position; and wherein the switch and at least two other switches are located in the switch carrier, the at least two other switches being actuated by components of the latch assembly and the switch and the at least two other switches are located in a first plane with respect to the latch assembly and the actuating lever rotates in the first plane and wherein the lock lever rotates in a second plane with respect to the latch assembly, the second plane being different from the first plane.

16. The latch as in claim 15, wherein the switch is operatively coupled to an electronic control unit (ECU) and wherein a state of the switch corresponds to a position of the lock lever.

17. The latch as in claim 15, wherein the actuating lever further comprises a cam follower feature and an integral return spring for biasing the actuating lever into the first position, wherein the cam follower feature contacts a cam surface of the lock lever as the lock lever moves from the first position to the second position.

18. The latch as in claim 17, wherein the integral return spring contacts a positioning feature of the switch carrier in order to provide a biasing force to the actuating lever when the lock lever moves from the first position to the second position.

19. The latch as in claim 18, wherein the actuating lever has a shaft portion that is rotatably received in a bearing pocket that is also integral to the switch carrier.

20. A method for determining a position of a lock lever of a latch, comprising:

rotatably mounting the lock lever to the latch for movement between a first position corresponding to a locked position of the latch and a second position corresponding to an unlocked position of the latch, wherein the lock lever is configured to prevent the latch from transitioning between a latched position and an unlatched position when it is in the first position and the lock lever allows the latch to transition between the latched position and the unlatched position when it is in the second position;

providing a switch to detect movement of the lock lever between the first position and the second position, the switch being located in a switch carrier;

rotatably mounting an actuating lever to the switch carrier for movement between a first position and a second position, wherein the actuating lever is operably coupled to the lock lever such that movement of the lock lever from the first position to the second position causes the actuating lever to move from the first position to the second position such that the switch is actuated by the actuating lever, wherein the actuating lever is spring biased into the first position; and wherein the switch and at least two other switches are located in the switch carrier, the at least two other switches being actuated by components of the latch assembly, and wherein the switch and the at least two other switches are located in a first plane with respect to the latch assembly and the actuating lever rotates in the first plane and the lock lever rotates in a second plane with respect to the latch assembly that is different from the first plane and wherein the switch provides a signal to an electronic control unit.

* * * * *